United States Patent [19]

Van Brocklin

[11] Patent Number: 4,773,553

[45] Date of Patent: Sep. 27, 1988

[54] ASSEMBLY FOR SECURING AND SEALING A DISPENSER TO A FLANGED CONTAINER

[75] Inventor: Owen F. Van Brocklin, Bristol, Conn.

[73] Assignee: Risdon Corporation, Naugatuck, Conn.

[21] Appl. No.: 49,721

[22] Filed: May 12, 1987

Related U.S. Application Data

[63] Continuation-in-part of Ser. No. 775,132, Sep. 12, 1985, abandoned.

[51] Int. Cl.[4] ..... B65D 47/00

[52] U.S. Cl. ..... 215/272; 215/274; 222/321

[58] Field of Search ..... 215/272, 274; 222/321, 222/545, 562, 570

[56] References Cited

U.S. PATENT DOCUMENTS

| | | | |
|---|---|---|---|
| 1,609,453 | 12/1926 | Atwood | 215/272 |
| 2,723,773 | 11/1955 | Greene | 215/272 X |
| 4,073,398 | 2/1978 | Schultz | 215/274 X |
| 4,173,297 | 11/1979 | Pettersen | 222/321 |
| 4,251,003 | 2/1981 | Bodenmann | 215/272 X |
| 4,279,353 | 7/1981 | Honma | 215/272 X |
| 4,359,166 | 11/1982 | Dubach | 215/272 |

FOREIGN PATENT DOCUMENTS

| | | | |
|---|---|---|---|
| 2534557 | 4/1984 | France | 215/272 |
| 2708530 | 8/1978 | Fed. Rep. of Germany | 215/272 |
| 549372 | 10/1956 | Italy | 215/272 |

*Primary Examiner*—Donald F. Norton

*Attorney, Agent, or Firm*—St. Onge Steward Johnston & Reens

[57] ABSTRACT

An assembly for securing and sealing a dispenser, such as a pump or valve, to a flanged container is disclosed. The assembly comprises a mounting cup having a generally cylindrical skirt around its periphery and a sealing collar including a sleeve having a diameter sized to receive the sidewall of the flange and sized to be encased by the mounting cup. The end portion of the sleeve, preferably a plurality of spaced tabs, is in the path of movement of the mounting cup and is deformed radially inwardly beneath the flange ledge thereby to secure the collar to the flange.

28 Claims, 6 Drawing Sheets

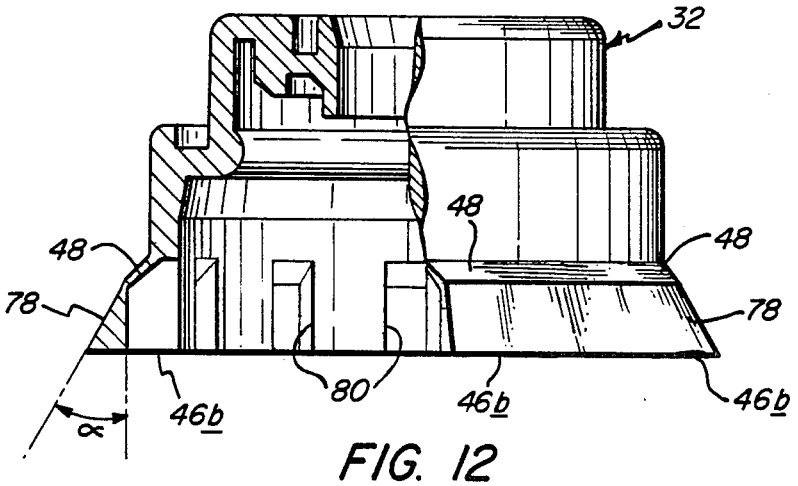
FIG. 12
FIG. 14
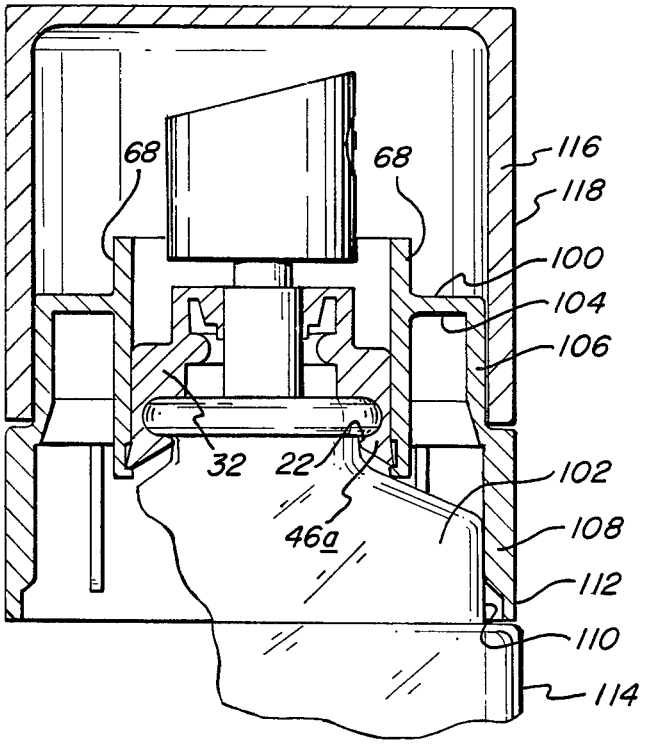

ASSEMBLY FOR SECURING AND SEALING A DISPENSER TO A FLANGED CONTAINER

CROSS-REFERENCE TO RELATED APPLICATION

This application is a continuation-in-part of application Ser. No. 775,132 filed Sept. 12, 1985, now abandoned.

BACKGROUND OF THE INVENTION (1) Field of the Invention

The present invention relates to a method and assembly for securing and sealing a dispenser, such as a pump, a valve or other dispensing means with respect to a flanged container. More particularly, the present invention relates to an assembly and method for securing a dispenser to a container without the necessity of complex mechanical operations.

(2) Brief Description of the Prior Art

It is desirable to secure a dispenser such as a pump, a valve, or other dispensing means to a container for storing a liquid product. A typical container may be made of glass and have a neck with an opening for dispensing the product. A flange is included around the opening and has an inwardly directed ledge.

An assembly in accordance with the invention can be used with a pump of the type disclosed in U.S. Pat. No. 4,173,297 to Pettersen. The Pettersen patent discloses a pump that is mounted with respect to the container through use of a metal mounting ferrule, also termed a mounting cup. The bottom of the skirt of the mounting cup is deformed beneath the container flange to retain the pump and associated seal in place. Such crimping operation requires specialized machinery made specifically for such crimping operation. Thus, filling of the bottle must be accomplished adjacent a relatively complex crimping device. Moreover, since each dispenser must be positioned, and then crimped, the process of crimping the mounting cups is relatively time consuming. In certain applications, it may be desirable to avoid an appearance wherein the end of the mounting cup is crimped, and this is particularly the case in certain cosmetic applications wherein the outward appearance of the package is important.

In designs where the mounting cup has been crimped, it may be desirable to provide an additional appearance sleeve which fits over the mounting cup and obscures the crimped portion of the mounting cup. The use of an additional sleeve adds to the cost of the components and assembly of the components.

It has been proposed to use a hard plastic collar having an annular recess which receives the flange, or bead as it is also termed. An annular retaining rib snap-locks under the flange or bead when installed. Such designs are disclosed in U.S. Pat. Nos. 4,216,883, 4,193,551 and 4,073,398. The latter patent discloses a retainer collar that holds the annular retaining rib beneath the container flange. The snap-locking feature of such designs typically requires use of hard plastics which are not effective for providing a liquid seal.

Wassilieff U.S. Pat. No. 3,905,502 describes a re-usable stopper for a bottle or like container wherein a sealing element is provided with an annular portion deformable against the container to provide a seal. A sleeve surrounding the sealing element is movable axially from a first position in which the stopper can be removed from the container to a second position in which the sleeve applies radial force to the annular portion of the sealing element and thereby seals the container. Related devices are shown in Honma U.S. Pat. No. 4,279,353, British Pat. No. 1,442,433, German Pat. OLS No. 2,307,715, and Italian Pat. No. 549,372. None of these specifications shows a means of securing and sealing a dispenser with respect to the flange of a container.

Thus, it is an object of the present invention to provide an assembly and a method for securing and sealing a dispenser with respect to the flange of a container in a simplified fashion which requires relatively unsophisticated equipment for assembly. In accordance with one aspect of the invention it is desired to provide an assembly and a method for securing and sealing which does not require crimping of the metal mounting cup beneath the flange of the container. In accordance with another object of the invention, it would be desirable to avoid use of an appearance sleeve for obscuring the crimped portion of the mounting cup.

SUMMARY OF THE INVENTION

In accordance with one aspect of the invention, an assembly for securing and sealing a dispenser, such as a pump or a valve, to a flanged container is disclosed. The assembly comprises a mounting cup comprising a substantially rigid material, such as, for example, metal wherein the cup has a skirt around its periphery. The cup is slideable through a path of movement over the container flange to an assembled position.

The assembly also includes a sealing collar comprising a deformable material, preferably a resilient deformable material. The collar has a ring including a floor that is in contact with the upper surface of the flange in the assembled position. The collar includes a sleeve depending from the ring wherein the sleeve has a diameter sized to receive the sidewall of the flange, but also is sized to be encased by the mounting cup skirt. The sleeve includes an end portion protruding in the path of movement of the skirt. When the sealing collar and mounting cup are assembled, the sleeve forces the protrusion inwardly to a position beneath the flange of the container thereby securing the collar to the flange.

In accordance with one aspect of the invention, at least a portion of the sleeve is tapered, and preferably frustoconical, in shape wherein the upper region of the frustoconical sleeve has a diameter less than the flange diameter. The lower region of the frustoconical sleeve has a diameter equal or greater than the flange diameter. When the frustoconical sleeve is forced over the flange, it deforms slightly and provides an annular area of contact, which seals the collar.

In accordance with one aspect of the invention, the container flange, the mounting cup and the sealing collar are all symmetric to a central axis. During assembly of the components, the axes of the mounting cap, the sealing collar and the flange are placed in a coincident relation and are assembled by moving the three components together. More specifically, the container, and thus the flange is held in a stationary position. The sealing collar and the mounting cup are placed on the container flange, and the mounting cup is urged in an axial direction toward the flange. The mounting cup skirt as it slides with respect to the sealing collar sleeve forces and deforms the protruding end portion radially inwardly and into a position beneath the ledge of the flange. Thus, the flange is securely grasped at one end by the ring and at the other end by the deformed end portion of the sleeve of the sealing collar. Thus, a secure seal is provided.

In accordance with one aspect of the invention, the skirt of the mounting cup includes a radially outwardly directed step. The portion of the mounting cup skirt above the step has an inner diameter slightly less than the outer diameter of the sealing collar sleeve. The surface of the mounting cup skirt frictionally engages the outer surface of the sleeve of the sealing collar to retain the components in an assembled position with respect to each other. The skirt may also include a second radially stepped portion which contacts the ring and holds it in position when the components are assembled.

In accordance with another aspect of the invention the end portion of the sleeve includes a plurality of slots around its periphery. The slots define a plurality of deformable tabs which are deformed as the mounting cup moves through its path of movement.

In a preferred embodiment the outer surfaces of the deformable tabs are inclined outwardly and downwardly at an angle to the vertical in order to increase the holding force between the inner surface of the tabs and the underside of the flange when the tabs are deformed inwardly by downward movement of the mounting cup skirt. In an optional but preferred embodiment the gaps between lower edges of the deformable tabs are bridged by flexible web members which, when deformed by downward movement of the mounting cup skirt serve to enhance further the holding force between the tabs and the underside of the flange.

The assembly of the present invention is particularly simple in design and requires only two components in addition to the container flange. The components are assembled by urging the mounting cup and the sealing collar toward the container flange in an axial direction. Optionally a second flange, adapted to receive the lower skirt of the mounting cup, is provided on the neck of the container to facilitate the assembly and avoid misalignment of the components during the assembly. No sophisticated mechanical devices are necessary for assembling the components and the components are assembled by axial movement of the mounting cup. The advantage of the simplified assembly is important. In many applications, the person filling the bottles may not have access to sophisticated machinery for crimping, and therefore, a device which permits ease in assembly is particularly desirable. In addition, the mounting cup does not require crimping. Thus, the appearance of the bottom of the mounting cup is attractive and an additional appearance sleeve is unnecessary. Additional advantages of an assembly and method in accordance with the invention will be apparent from the brief description of the drawings and a detailed description of the invention which follows.

BRIEF DESCRIPTION OF THE DRAWINGS

FIG. 12 is a side view partially broken away of another embodiment of a sealing collar of the invention;

FIG. 14 is a sectional view of an alternative embodiment of the mounting cup which provides for ease of attachment of an aesthetically pleasing mounting cup.

DETAILED DESCRIPTION OF THE INVENTION

Figure 1:
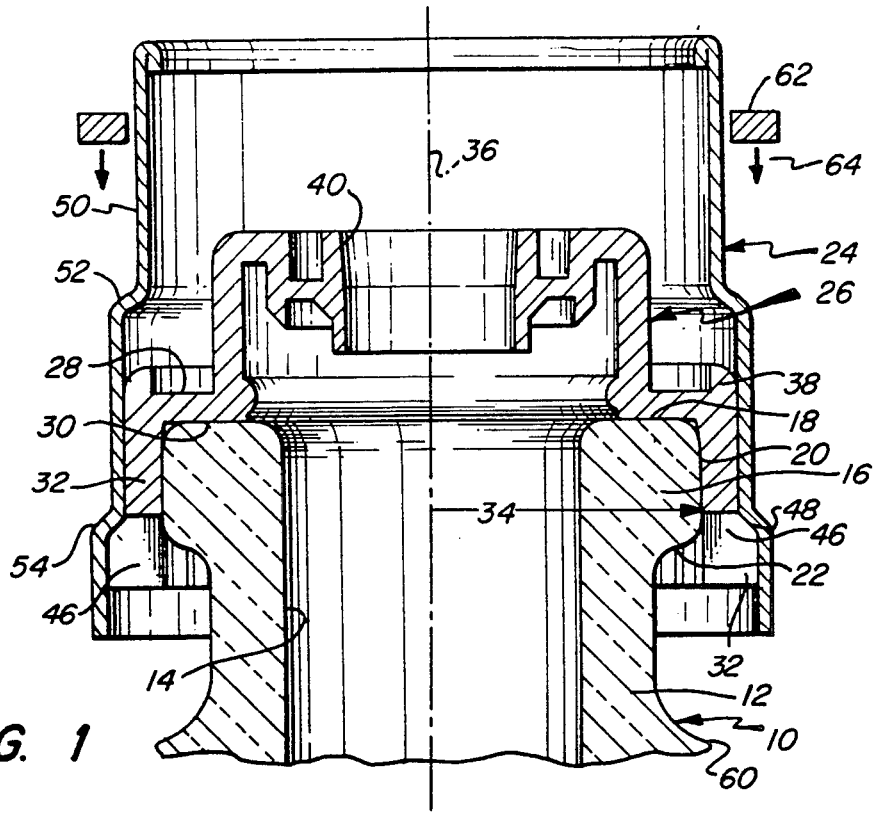
FIG. 1 is a sectional view taken along the common axis of the components of the assembly, and shows the components prior to assembly.
Figure 2:
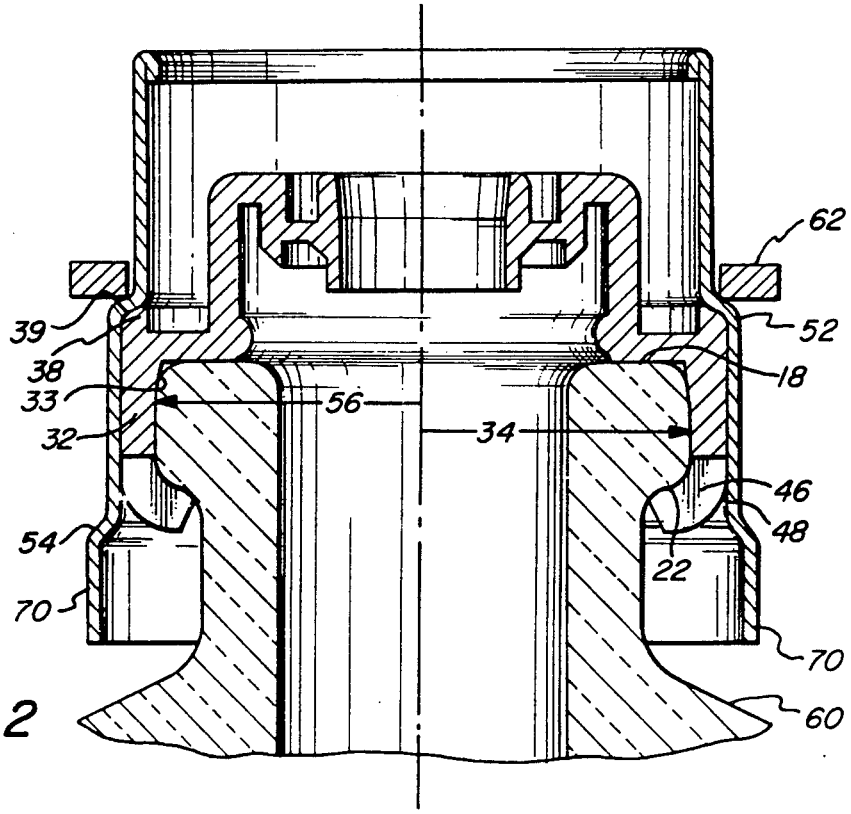
FIG. 2 is a view similar to that shown in FIG. 1 with the exception that the components have been assembled.

Referring to FIGS. 1 and 2, a container 10 of the type having a neck 12 with an opening 14 for dispensing product stored in the container is shown. The neck includes a flange 16 which includes an upper surface 18 surrounding the opening 14, a sidewall 20 about its periphery and an inwardly directed ledge 22 at the bottom of the flange. The container is typically made of glass, although other types of materials such as plastic or metal can be utilized. An assembly in accordance with the present invention is particularly suited for use with cosmetic containers such as those containing perfume.

An assembly in accordance with the present invention includes a mounting cup 24 and a sealing collar 26. The sealing collar 26 comprises a deformable material, and preferably a resilient deformable material such as polyethylene, including linear low density polyethylene, rubber elastomers or vinyl. The sealing collar 26 includes a ring 28 having a floor 30 for contacting the upper surface 18 of the container flange. The collar includes a sleeve 32 extending from the ring 28. The sleeve has an inner diameter sized to receive the sidewall 20 of the flange, and preferably, the inner diameter 34 of the sleeve 32 is slightly less than the diameter of the flange wall 20 to provide a snug, frictional fit. The sleeve 32 is preferably generally cylindrical and symmetric with respect to axis 36. The upper end of sleeve 32 includes an annular protrusion 38 which is shaped to be received by the interior surface of a step in the mounting cup 24, and such will be described hereinafter.

The sealing collar 26 can be designed to receive any number of different types of dispensers including pumps, valves, shaker plug type valve, squeeze type valves, and pouring type valves. The collar includes a central opening 40 for receiving the dispenser, such as a pump, and includes other structures which are designed specifically for the type of dispenser to be used with the assembly. Thus, the portion of the sealing collar above the ring is not described in detail inasmuch as it can be changed and adapted to various types of dispensers.

Figure 3:
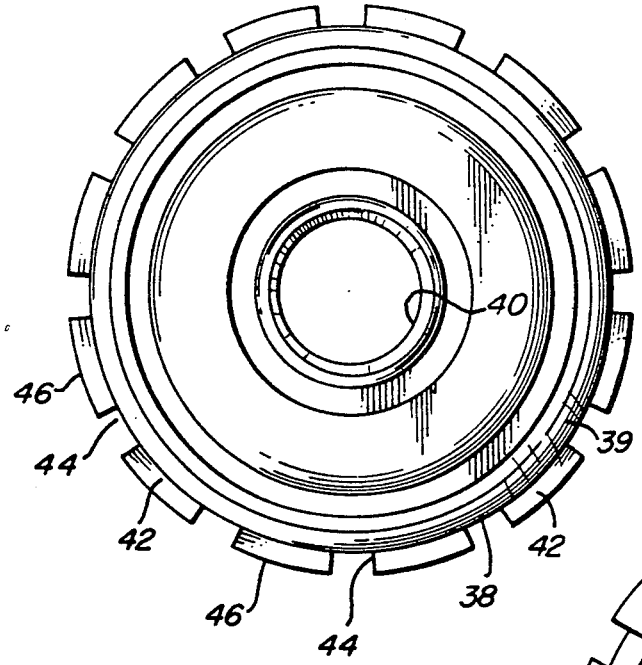
FIG. 3 is a top view of the sealing collar shown in FIGS. 1–2.
Figure 4:
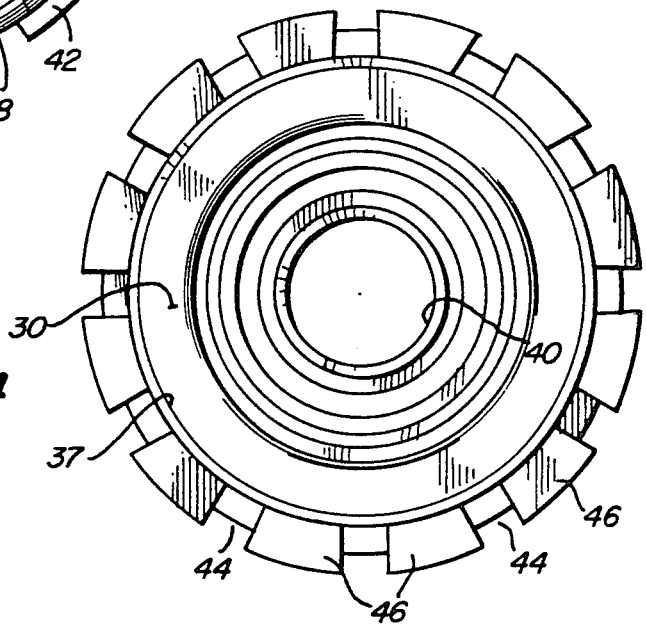
FIG. 4 is the bottom view of the sealing collar shown in FIGS. 1–3.
Figure 5:
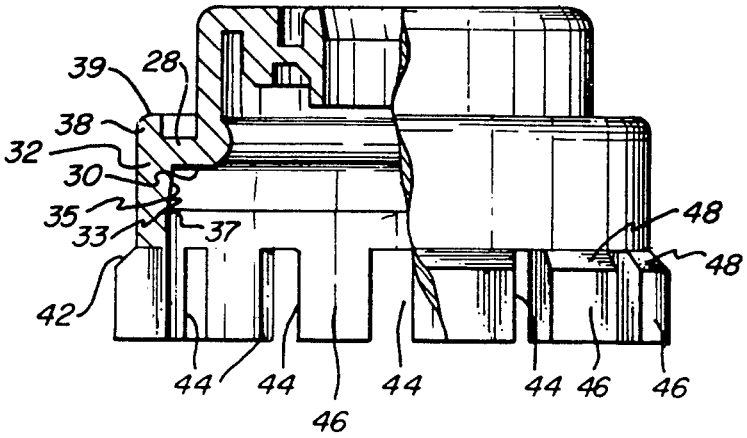
FIG. 5 is a side view partially broken away of the sealing collar shown in FIGS. 1–4.

Referring in particular to FIGS. 3, 4 and 5, the end portion of sleeve 32 includes a radially outwardly protruding member 42 located in the path of movement of the mounting cup 24. More specifically, the sleeve includes a plurality of slots 44 about its periphery. The slots 44 define a plurality of deformable tabs 46. It is preferred that the tabs 46 include an inclined camming surface 48 (See FIG. 5). When the sleeve moves downwardly it contacts camming surface 48 and forces each of the tabs radially inwardly. The camming surface preferably has an angle with respect to the vertical axis 36 of between 30 and 60 degrees, most preferably 45 degrees. It is preferable that the sealing collar be of a molded polymeric material which can be formed in a single piece. Alternatively, if necessary, the collar could be formed in a plurality of pieces so long as the tabs 46 are deformable.

As shown particularly well in FIG. 5, the sleeve 32 also includes a frustoconical portion 33. The upper region 35 has a diameter less than the diameter of the flange while the lower region 37 has a diameter equal to or greater than the flange diameter. As shown in FIG. 2, when assembled, the frustoconical portion deforms slightly and contacts the flange to provide an annular area 39 of contact.

Referring to FIGS. 1 and 2, the mounting cup 24 will now be described in detail. The mounting cup is preferably made of a material which is substantially rigid, such as metal, hard plastic, wood or glass. The cup 24 includes a skirt 50 which has a shape symmetric with respect to common axis 36. More specifically, the mounting cup has a generally cylindrical shape, but may also have a frustoconical shape symmetric with respect to central axis 36. In the embodiment shown in FIGS. 1 and 2 the skirt 50 includes a first stepped portion 52 and a second stepped portion 54. Both steps 52 and 54 are directed radially outwardly from central axis 36 so that the entire cup can be placed over both the sealing collar and the container flange. The inner diameter 56 of the portion of the cup between steps 52 and 54 is approximately equal to the outer diameter of sleeve 32. If desired, the inner diameter 56 of the cup can be slightly less than the outer diameter of sleeve 32 so that the sleeve is slightly compressed between the flange sidewall 20 and the interior surface of the mounting cup.

Both steps 52 and 54 are at an angle with respect to central axis 36 so as to match respectively the angles on annular protrusion 38 and camming surface 48. More specifically, as shown in FIG. 2, in an assembled position, the step portion 52 contacts the upper surface 39 of annular protrusion 38 and forces the ring 28 into contact with the upper surface 18 of the flange. Also, as shown in a comparison between FIGS. 1 and 2, the step portion 54 contacts the camming surface 48 and forces the tab 46 radially inwardly beneath ledge 22. It should be understood that by a "ledge" it is meant an inward slot or groove which is capable of receiving tab 46. In certain instances, it may be desirable to include a flange having a continuous sidewall which extends to the shoulder 60 of the bottle. In such instance, the ledge would be simply an annular groove sized to receive the deformed tab 46. The method and apparatus for assembling the various components will be described with respect to FIG. 2.

The apparatus for assembling the device includes an annular ring 62 that is movable downwardly in the direction of arrow 64 to the position shown in FIG. 2. The annular ring is shown schematically and is connected to suitable mechanical devices for moving the ring downwardly. The container is maintained in a stationary position, and the components slide only along the axis 36 which is an axis common to the mounting cup, the sealing collar and the container flange. The sealing collar 26 may be placed on the flange in the position shown in FIG. 1. Alternatively, if desired, the sealing collar could be placed at a position wherein there is a space between the ring 28 and the upper surface 18 of the flange. The mounting cup 24 is placed over the sealing collar 26 and forced axially downwardly with respect to the container. The ring 62 contacts the step 52 and urges the cup downwardly. The stepped portion 54 contacts the camming surface 48 and exerts a downward force on the entire sealing collar. In the instance where the ring 28 is spaced from the flange 16 in an initial condition, the force of the step 54 against the camming surface 48 urges the entire sealing collar axially downwardly. During movement of the sealing collar with respect to the flange, the tabs 46 are blocked from radially inward movement until they reach the position shown in FIG. 2. The collar ring 28 when it contacts the upper surface of the flange limits further movement of the collar with respect to the flange. Thereafter, as the mounting cup 24 is forced axially downwardly by the annular ring 62, the step 54 urges the camming surface radially inwardly and thus deforms the tabs to the position shown in FIG. 2.

The method of assembly has been described with the annular ring 62 moving with respect to a stationary container. It should be understood that it is the relative movement which produces the assembly of the various components, and it is also possible to move the container and the various components upwardly with respect to an annular ring.

Figure 6:
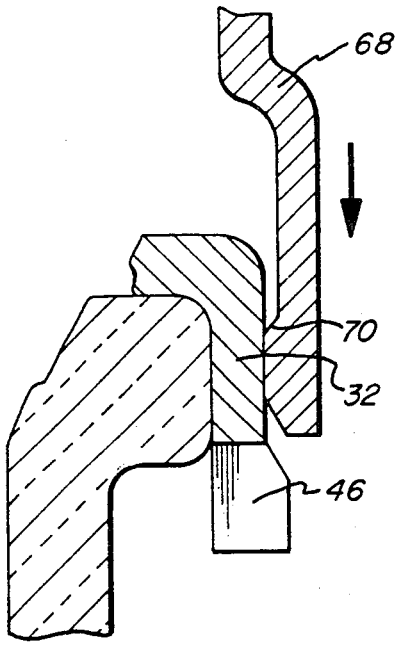
FIG. 6 is a partial sectional view of another embodiment of the invention prior to assembly.
Figure 7:
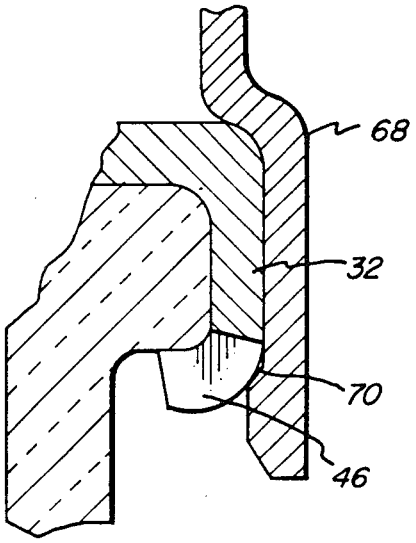
FIG. 7 is a view similar to that of FIG. 6 after assembly.

Referring to FIGS. 6 and 7, another embodiment of the invention is shown. The container and sealing collar are identical to those shown in FIGS. 1–5. The mounting cup 68 includes an annular retaining ring 70 which protrudes radially inwardly beneath the deformed tabs 46 when in an assembled position. More specifically, the mounting cup 68 is made of a plastic material having a small degree of flexibility which permits it to slightly deform radially outwardly as it rides over sleeve 32. When tabs 46 are deformed, retaining ring 70 snaps into the position shown in FIG. 7 beneath deformed tabs 46. The snap-lock provided by ring 70 assists in maintaining the various components in assembly.

As can be appreciated, the method of assembly is particularly simple and does not require complicated machinery. The only required step is the reciprocating of an annular ring which contacts one of the step portions of the mounting cup. If necessary, the components could be assembled by a hand press. As shown in the assembled version in FIG. 2, the three components, the sealing collar, the mounting cup and the container flange are held in a substantially fixed position by the frictional forces between the parts. The flange is secured between the deformed tab 46 and the ring 28 to hold the assembly in a fixed position. Although it is desirable to use an assembly according to the present invention to avoid the necessity of a subsequent crimping operation, in some instances it may be desirable to crimp the terminal end 70 of the mounting cup around the deformed tabs. This would particularly be the case if a crimped appearance were to be desired.

Figure 8:
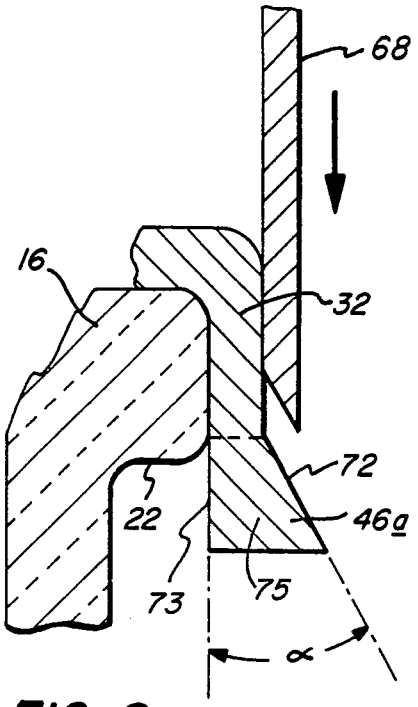
FIG. 8 is a partial sectional view of another embodiment of the invention prior to assembly.
Figure 9:
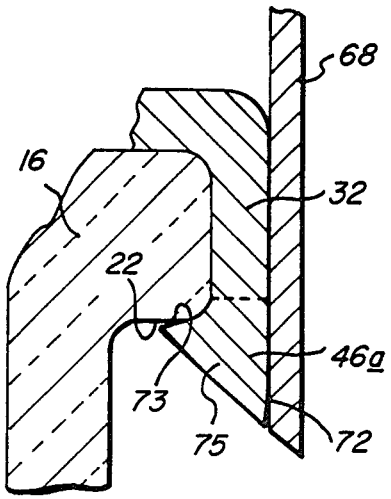
FIG. 9 is a view similar to that of FIG. 8 after assembly.

FIGS. 8 and 9 illustrate a modification of the embodiment shown in FIGS. 6 and 7. The container and sealing collar are identical to those shown in FIGS. 1-5. The mounting cup 68, of which only the lower portion is shown, is unstepped i.e., is cylindrical with a substantially uniform diameter throughout its length. As shown in FIG. 8, the frustoconical surface 72 of the tab 46*a* slopes outwardly and downwardly at an angle $\alpha$ with respect to the vertical axis of the container. The angle $\alpha$ is advantageously of the order of about 60 degrees to about 30 degrees. In the assembled position shown in FIG. 9, the tab 46*a* has been deformed inwardly with its inner surface 73 in sealing, gripping contact with the underside 22 of flange 16. The bottom portion 75 of tab 46*a* is compressed between the underside 22 of flange 16 and the interior surface of mounting cup 68. Most preferably, the width of bottom portion 75 is slightly greater than the distance between the underside 22 of flange 16 and the interior surface of mounting cup 68, when they are assembled, to provide an interference fit. The mounting cup is held in position by reason of the interference fit.

Figure 10:
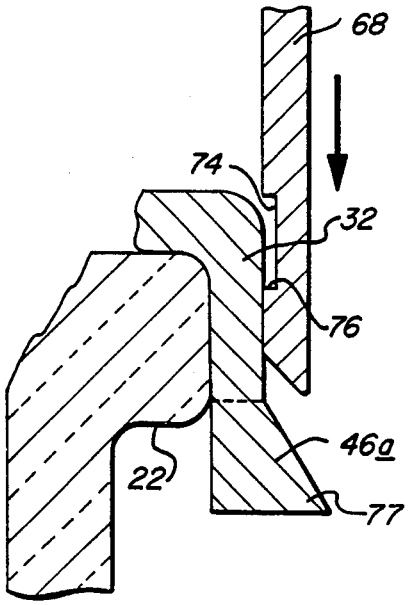
FIG. 10 is a partial sectional view of another embodiment of the invention prior to assembly.
Figure 11:
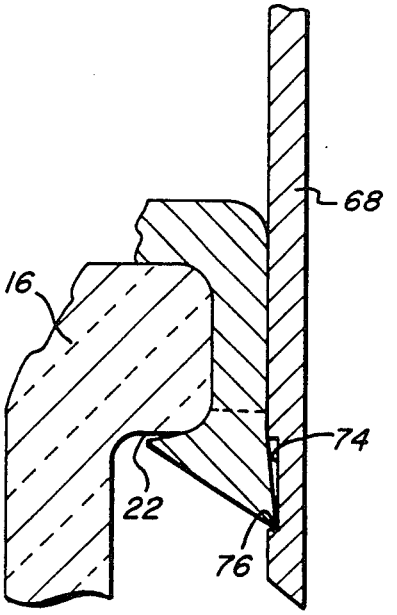
FIG. 11 is a view similar to that of FIG. 10 after assembly.

FIGS. 10 and 11 illustrate a further embodiment wherein the mounting cup 68 is provided with an annular groove 74 on the inner surface of the lower portion thereof. Groove 74 serves to receive the outermost tip 77 of tab 46*a* in locking engagment with the lower rim 76 of the groove 74 in the assembled position thus providing additional enhancement to the interference fit and further serves to hold the mounting cup in place.

FIG. 12 illustrates a further embodiment of the sleeve 32 shown in FIG. 5. The tabs 46*b* have an upper cammed surface 48 in addition to outwardly and downwardly inclined surfaces 78, the angle of inclination of the latter to the vertical being $\alpha$ as above defined. Each of the tabs 46*b* are connected to each of their neighbors by integrally formed thin flexible webs 80. As the mounting cup 24 is moved downwardly over the collar 32 during assembly of the device of the invention, the tabs 46*b* are deformed inwardly as hereinabove described and the web-like members 80 are flexed convexly outwardly to engage the inner wall of the skirt of the mounting cup 24. The webs 80 thereby contribute an additional compression component to the interference fit serving to hold the cup 24 in place on the assembled device of the invention. The webs 80 also provide for a smooth, continuous outer surface of the periphery of the mounting cup 24 thereby permitting ease of molding the cup 24 from plastic.

Figure 13:
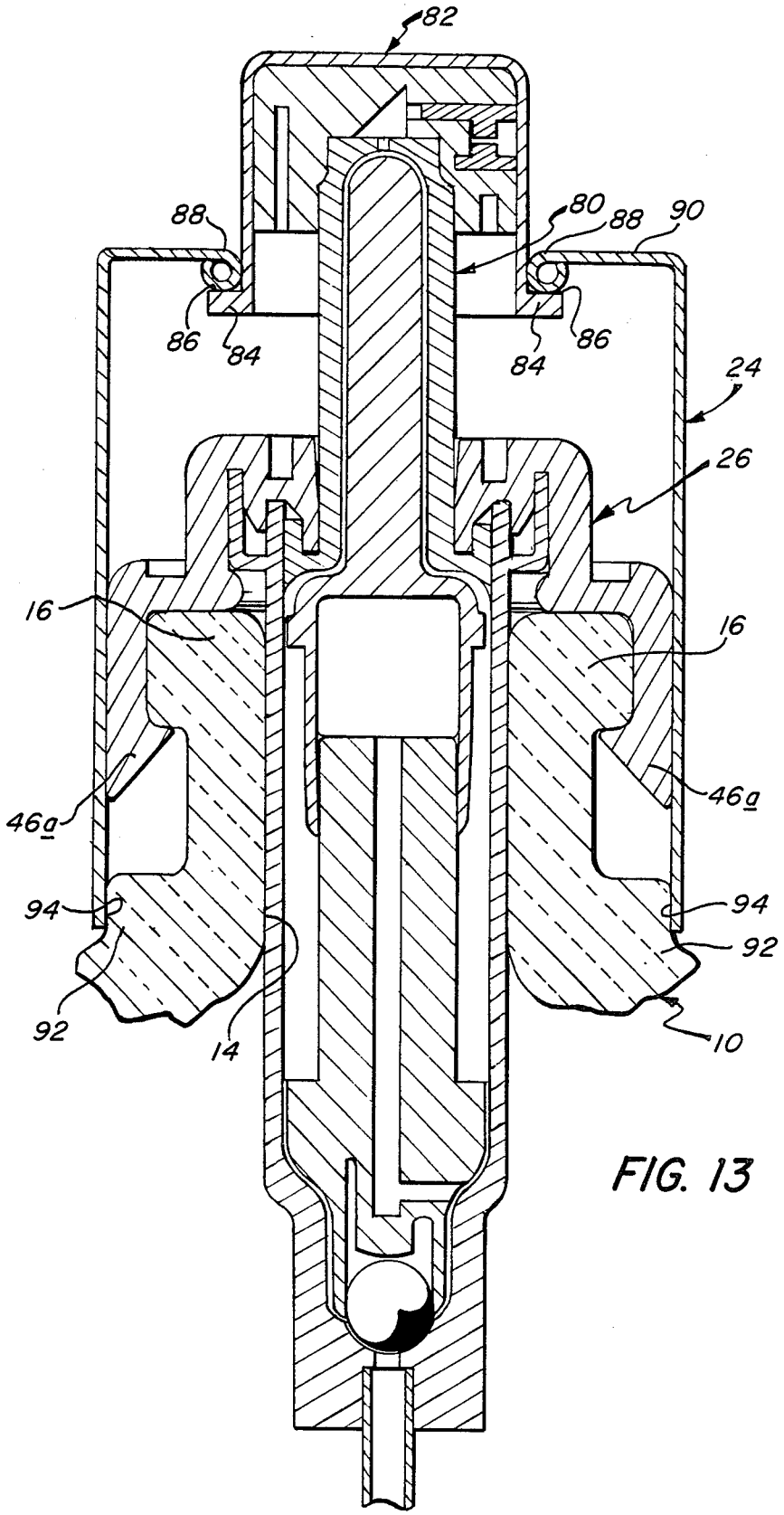
FIG. 13 is a sectional view, taken along the common axis of the components of the assembly, showing another embodiment of the invention after assembly of the components.

FIG. 13 shows a spray pump assembly 80 securely and sealingly in place on the flange 16 of a container (not shown in full) using an assembly of the invention. The various components of the latter are numbered as shown in embodiments previously discussed above. The spray pump assembly 80 is shown for purposes of illustration only as being typical of those known in the art. The mode of operation of the assembly is similar to that shown in the aforesaid U.S. Pat. No. 4,173,297 of Petterson and will not be explained in detail, since such will be immediately obvious to one skilled in the art. The pump is actuated by manual depression of actuator 82. In the embodiment shown, the actuator 82 is provided on its lower perimeter with flange 84, the upper surface 86 of which engages the underside of curled flange 88 disposed around the inner edge of the top 90 of mounting cup 24. This combination of elements forms a highly convenient method of maintaining the actuator 82 in place on the pump assembly and avoids the possibility of accidental displacement of the actuator during use, transportation and/or storage.

The embodiment of FIG. 13 also shows a second flange 92 disposed on the lower end of the outer surface of the neck 14 of the container 10. The vertical sidewall 94 of the second flange 92 engages the inner wall of the lower end portion of the skirt of mounting cap 24. This engagement of the mounting cup 24 with the sidewall of the second flange 92 in the above manner serves to ensure that the mounting cup is properly aligned coaxially with the neck 14 of container 10 during the actual assembly of the components and that the components are maintained thereafter in correct alignment. As will be apparent to one skilled in the art the same result can be achieved by means of an annular rim of the appropriate dimensions disposed on the outer surface of neck 14 at a location below the flange 16 but above the junction of the neck and main body of the container.

Referring to FIG. 14, an alternative embodiment of the invention is shown. The sealing collar 32 and the mounting cup 68 function identically to the sealing collar and mounting cup described with respect to FIGS. 8, 9, 10 and 11, and need not be described further here. The assembly shown in FIG. 14 further includes an appearance cover 100 that permits the sealing collar 58 and the top part of the bottle 102 to be hidden from view of the user of the dispensing device. More particularly, in prior applications wherein the sealing collar was metal and crimped underneath the bottle flange, manufacturers would have to add an additional appearance cover which would necessitate additional parts and additional means of attachment of the appearance cover to the mounting cup. Such type of installation would require two or more components and require additional manufacturing time. In accordance with the present invention, the mounting cup 68 consists essentially of a single piece molded polymeric material. In this way, the functional mounting cup 68 may be molded simultaneously with the appearance cover 100. The appearance cover can have various appearances depending upon the design desired by the manufacturer. In the case of the embodiment shown in FIG. 14, the appearance cover includes an annular web section 104 protruding radially outwardly from the mounting cup 68. The appearance cover then projects axially downwardly through cylindrical member 106. The cylindrical member 106 is designed to encompass and hide the upper portion of the bottle 102. The cylindrical portion 108 fits within a recess 110 in the bottle and includes an outer surface 112 which is flush with the outer surface 114 of the bottle. Thus, the appearance of the bottle is very simple and smooth. In addition, a top 116 may be provided which has an outer surface 118 that is flush with surfaces 112 and 114. In such manner, an aesthetically pleasing package can be provided, and the dispensing device can be installed on a container in one simple manufacturing step. Where hundreds of thousands of products are being manufactured, reducing the manufacturing operation to a single step, while producing a aesthetically pleasing design, would save much effort in the manufacture of such dispensing devices.

In summary, the present invention provides an extremely simplistic method of assembling the various components, and provides for an assembly that does not require crimping. The frictional forces between the components maintain the components in a fixed assembled position. The assembly is useful not only for pumps but also may be adapted for various types of dispensers including pumps, valves, shaker plug type valves, squeeze type valves and pouring type valves.

It should be understood that although specific embodiments of the invention have been described herein in detail, such description is for purposes of illustration only and modifications may be made thereto by those skilled in the art within the scope of the invention.

I claim:

1. A container assembly comprising:

a container having a neck with an opening for dispensing product, the neck having a flange including an upper surface surrounding the opening, a cylindrical sidewall about its periphery, said sidewall of said flange having a diameter and said neck including an inwardly directed ledge at the bottom thereof, for each said container the sidewall having a length which may vary within manufacturing tolerances;

a mounting cup comprising a substantially rigid material, said cup having a skirt around its periphery, said cup slideable through a path of movement over said container flange to an assembled position; and a sealing collar comprising a resilient deformable molded polymeric material, said collar having a central opening for receiving said dispenser, said collar including a generally cylindrical sleeve having a diameter sized to receive said flange sidewall and sized to be encased by said mounting cup skirt, at least a portion of said sleeve having an inner diameter less than said diameter of said flange sidewall to provide an annular area of contact between the sleeve and the flange sidewall and a snug, frictional fit therebetween, said sleeve including at the bottom thereof a camming surface protruding in said path of movement of said mounting cup for securing said sleeve, said sleeve bottom having an interior surface consisting essentially of a cylindrical shape adjacent said inwardly directed ledge of said container, said interior surface deforming radially inwardly under said ledge, said sleeve accommodating said normal manufacturing tolerances in said sidewall length, said camming surface being forced radially inwardly under said ledge as said mounting cup contacts it and moves said sleeve to said assembled position, said frictional fit between said flange sidewall and said sleeve maintaining said mounting cup, said sealing collar and said bottle flange in a fixed assembled position.

2. An assembly according to claim 1 wherein said skirt has an annular retaining ring projecting inwardly from said skirt, said retaining ring being positioned beneath said deformed end portion of said collar to maintain said collar and mounting cup in said assembled position.

3. An assembly according to claim 2 wherein said mounting cup comprises a hard plastic material and said collar comprises a soft plastic material.

4. A container assembly comprising:

a container having a neck with an opening for dispensing product, the neck having a generally circular flange symmetric to an axis, said flange including an upper surface surrounding the opening, a cylindrical sidewall about periphery, said sidewall of said flange having a diameter, and said neck including an inwardly directed ledge at the bottom thereof, for each said container the sidewall having a length which may vary within manufacturing tolerances;

a mounting cup comprising a substantially rigid material, said cup having a substantially continuous cylindrical skirt around its periphery, said skirt having a step protruding radially outwardly with respect to a central axis of said mounting cup, said cup being slideable through a path of movement wherein the central axis of the mounting cup is coincident with the axis of said container flange, said cup being movable to an assembled position;

a sealing collar comprising a resilient deformable molded polymeric material, said collar having a central opening for receiving said dispenser, said collar having a central axis, said collar being movable through a path of movement wherein said collar axis is coincident with said cup axis and said flange axis, said collar having an annular ring including a floor, said floor being in contact with said upper surface in said assembled position, said collar including a generally cylindrically shaped sleeve depending from said ring, said sleeve having a diameter sized to receive said flange sidewall and sized to be encased by said mounting cup wall, at least a portion of said sleeve having an inner diameter less than said diameter of said flange sidewall to provide an annular area of contact between the sleeve and the flange sidewall and a snug, frictional fit therebetween, said radial step of said mounting cup forcing said collar toward said flange as said cup slides through its path of movement, said sleeve including an end portion protruding radially in said path of movement of said mounting cup, said end portion being deformed radially inwardly under said ledge to secure said sealing collar with respect to said flange, said sleeve having an interior surface consisting essentially of a cylindrical shape adjacent said inwardly directed ledge of said container, said interior surface deforming downwardly and radially inwardly under said ledge, said sleeve accommodating said normal manufacturing tolerances in said sidewall length, said frictional fit between said flange sidewall and said sleeve maintaining said mounting cup, said sealing collar and said bottle flange in a fixed assembled position.

5. An assembly according to claim 4 wherein at least a portion of said mounting cup above said step has an inner diameter substantially equal to the outer diameter of said sealing collar sleeve, said inner diameter of said mounting cup wall frictionally engaging the outer diameter of sealing collar to retain said mounting cup in an assembled position with respect to said container.

6. An assembly according to claim 4 wherein said sleeve includes a frustoconical portion having an upper region having a diameter less than said flange diameter and having a lower portion having a diameter at least equal to said flange diameter, said frustoconical portion deforming and being in contact with said flange sidewall in an annular area.

7. An assembly according to claim 4 wherein said end portion of said sleeve includes a plurality of slots about its periphery, said slots defining a plurality of deformable tabs about the periphery of the end portion of said sleeve, said tabs being deformed as said mounting cup moves through its path of movement.

8. An assembly according to claim 4 wherein said end portion of said sleeve includes a camming surface in said path of movement of said mounting cup, said camming surface being forced radially inwardly by said sleeve to position said end portion beneath said edge.

9. A container assembly comprising a container having a neck with an opening for dispensing the product, the neck having a flange surrounding the opening, a sidewall about its periphery, said sidewall of said flange having a diameter, and said neck including an inwardly directed ledge at the bottom thereof, for each said container the sidewall having a length which may vary within manufacturing tolerances;

a mounting cup comprising a substantially rigid material, said cup having a skirt about at least a portion of its periphery, the cup slideable through a path of movement over the container flange to an assembled position;

a sealing collar comprising a resilient deformable molded polymeric material, said collar having a central opening for receiving said dispenser, said sealing collar including a sleeve having a diameter sized to receive the flange and sized to be encased by said mounting cup skirt, a portion of said sleeve having an inner diameter less than said diameter of said flange sidewall to provide an annular area of contact between the sleeve and the flange sidewall and a snug, frictional fit therebetween, said sleeve including a camming surface protruding into the path of movement of the mounting cup, said camming surface being forced by said mounting cup to a position under said ledge as the mounting cup moves to an assembled position, said sleeve having an interior surface consisting essentially of a cylindrical shape adjacent said inwardly directed ledge of said container, said interior surface deforming radially inwardly under said ledge, said sleeve accommodating said normal manufacturing tolerances in said sidewall length.

10. An assembly according to claim 9 and further including limiting means comprising a ring integral with the sealing collar, said ring including a floor contacting said flange in said assembled position, said sleeve depending from said ring.

11. An assembly according to claim 10 wherein said limiting means comprises a tapered portion of said sleeve having a diameter less than the diameter of said flange sidewall, said tapered portion contacting said flange sidewall and deforming to seat said collar on said flange.

12. An assembly according to claim 11 wherein said tapered portion has a frustoconcial shape.

13. An assembly according to claim 9 wherein said skirt has an annular retaining ring projecting inwardly from said skirt, said retaining ring and skirt adjacent said retaining ring deforming outwardly as said retaining ring slides over said collar sleeve, said ring returning to its undeformed condition beneath said deformed end portion of said collar to maintain said collar and mounting cup in said assembled position.

14. A container assembly comprising:

a container having a neck with an opening for dispensing product, the neck having a generally circular flange symmetric to a central axis, said flange including an upper surface surrounding the opening, a cylindrical sidewall about periphery, said sidewall of said flange having a diameter, and said neck including an inwardly directed ledge at the bottom thereof, for each said container the sidewall having a length which may vary within manufacturing tolerances;

a mounting cup comprising a substantially rigid material, said cup having a substantially continuous cylindrical skirt around its periphery, said skirt being symmetrical with respect to a central axis of said mounting cup, said cup being slideable through a path of movement wherein the central axis of the mounting cup is coincident with the axis of said container flange, said cup being movable to an assembled position, said cup including an appearance cover spaced radially outwardly from and secured with respect to the cylindrical skirt, said mounting cup considering essentially of a single piece molded polymeric material; and a sealing collar comprising a resilient deformable molded polymeric material, said collar having a central opening for receiving said dispenser, said collar having a central axis, said collar being movable through a path of movement wherein said collar axis is coincident with said cup axis and said flange axis, said collar including a generally cylindrically shaped sleeve depending from said ring, said sleeve having a diameter sized to receive said flange sidewall and sized to be encased by said mounting cup wall, at least a portion of said sleeve having an inner diameter less than said diameter of said flange sidewall to provide an annular area of contact between the sleeve and the flange sidewall and a snug, frictional fit therebetween, said mounting cup forcing said collar toward said flange as said cup slides through its path of movement, said sleeve including an end portion protruding radially in said path of movement of said mounting cup, said end portion being deformed radially inwardly under said ledge to secure said sealing collar with respect to said flange, said sleeve having an interior surface consisting essentially of a cylindrical shape adjacent said inwardly directed ledge of said container, said interior surface deforming radially inwardly under said ledge, said sleeve accommodating said normal manufacturing tolerances in said sidewall length, said frictional fit between said flange sidewall and said sleeve maintaining said mounting cup, said sealing collar and said bottle flange in a fixed assembled position.

15. An assembly for securing and sealing a dispenser with respect to flanged containers comprising:

a mounting cup comprising a substantially rigid material, said cup having a skirt around its periphery, said cup slideable through a path of movement over a sealing collar to an assembled position;

said sealing collar comprising a resilient deformable molded polymeric material, said collar having a central opening, said collar including a generally cylindrical sleeve having a diameter sized to be encased by said mounting cup skirt, said sleeve including at the bottom thereof a camming surface protruding in said path of movement of said mounting cup for securing said sleeve, said sleeve having an interior surface consisting essentially of a cylindrical shape, said interior surface deforming radially inwardly said camming surface being forced radially inwardly as said mounting cup contacts it and moves past said camming surface said sleeve to said assembled position, said sleeve maintaining said mounting cup, said sealing collar in a fixed assembled position.

16. An assembly for securing and sealing a dispenser with respect to flanged containers comprising:

a mounting cup comprising a substantially rigid material, said cup having a substantially continuous cylindrical skirt around its periphery, said skirt having a step protruding radially outwardly with respect to a central axis of said mounting cup, said cup being slideable through a path of movement to an assembled position;

a sealing collar comprising a resilient deformable molded polymeric material, said collar having a central opening, said collar having a central axis, said collar being movable through a path of movement wherein said collar axis is coincident with said cup axis, said collar having an annular ring including a floor, said floor being in contact with said upper surface in said assembled position, said collar including a generally cylindrically shaped sleeve depending from said ring, said sleeve having a diameter sized to be encased by said mounting cup wall, said radial step of said mounting cup forcing said collar radially inwardly as said cup slides through its path of movement, said sleeve including an end portion protruding radially in said path of movement of said mounting cup, said end portion being deformed radially inwardly, said sleeve having an interior surface consisting essentially of a cylindrical shape, said interior surface deforming radially inwardly, said sleeve maintaining said mounting cup and, said sealing collar in a fixed assembled position.

17. An assembly according to claim 16 wherein at least a portion of said mounting cup above said step has an inner diameter substantially equal to the outer diameter of said sealing collar sleeve, said inner diameter of said mounting cup wall frictionally engaging the outer diameter of sealing collar to retain said mounting cup in an assembled position.

18. An assembly according to claim 16 wherein said skirt has an annular retaining ring projecting inwardly from said skirt, said retaining ring being positioned beneath said deformed end portion of said collar to maintain said collar and mounting cup in said assembled position.

19. An assembly according to claim 18 wherein said mounting cup comprises a hard plastic material and said collar comprises a soft plastic material.

20. An assembly according to claim 16 wherein said sleeve includes a frustoconical portion having an upper region having a diameter less than said flange diameter and having a lower portion having a diameter at least equal to said flange diameter, said frustoconical portion deforming and being in contact with said flange sidewall in an annular area.

21. An assembly according to claim 16 wherein said end portion of said sleeve includes a plurality of slots about its periphery, said slots defining a plurality of deformable tabs about the periphery of the end portion of said sleeve, said tabs being deformed as said mounting cup moves through its path of movement.

22. An assembly according to claim 16 wherein said end portion of said sleeve includes a camming surface in said path of movement of said mounting cup, said camming surface being forced radially inwardly by said sleeve.

23. An assembly for securing and sealing a dispenser with respect to a flanged container comprising:

a mounting cup comprising a substantially rigid material, said cup having a skirt about at least a portion of its periphery, the cup slideable through a path of movement to an assembled position;

a sealing collar comprising a resilient deformable molded polymeric material, said collar having a central opening, said sealing collar including a sleeve having a diameter sized to be encased by said mounting cup skirt, said sleeve including a camming surface protruding into the path of movement of the mounting cup, said camming surface being forced by said mounting cup radially inwardly as the mounting cup moves to an assembled position, said sleeve having an interior surface consisting essentially of a cylindrical shape.

24. An assembly according to claim 23 wherein said limiting means comprises a ring integral with the sealing collar, said ring including a floor, said sleeve depending from said ring.

25. An assembly according to claim 24 wherein said limiting means comprises a tapered portion of said sleeve having a diameter less than the diameter of said flange sidewall, said tapered portion deforming to seat said collar.

26. An assembly according to claim 25 wherein said tapered portion has a frustoconcial shape.

27. An assembly according to claim 23 wherein said skirt has an annular retaining ring projecting inwardly from said skirt, said retaining ring and skirt adjacent said retaining ring deforming outwardly as said retaining ring slides over said collar sleeve, said ring returning to its undeformed condition beneath said deformed end portion of said collar to maintain said collar and mounting cup in said assembled position.

28. An assembly for securing and sealing a dispenser with respect to flanged containers comprising:

a mounting cup comprising a substantially rigid material, said cup having a substantially continuous cylindrical skirt around its periphery, respect to a central axis of said mounting cup, said cup being slideable through a path of movement along the central axis of the mounting cup, said cup being movable to an assembled position, said cup including an appearance cover spaced radially outwardly from and secured with respect to the cylindrical skirt, said mounting cup consisting essentially of a single piece molded polymeric material;

a sealing collar comprising a resilient deformable molded polymeric material, said collar having a central opening, said collar having a central axis, said collar being movable through a path of movement wherein said collar axis is coincident with said cup axis, said collar including a generally cylindrically shaped sleeve depending from said ring, said sleeve having a diameter sized to be encased by said mounting cup wall, said mounting cup forcing said collar radially inwardly as said cup slides through its path of movement, said sleeve including an end portion protruding radially in said path of movement of said mounting cup, said end portion being deformed radially inwardly to secure said sealing collar with respect to said flange, and said sleeve having an interior surface consisting essentially of a cylindrical shape adjacent said inwardly directed ledge of said container, said interior surface deforming radially inwardly.

* * * * *